US005213320A

United States Patent [19]

Hirota et al.

[11] Patent Number: 5,213,320

[45] Date of Patent: May 25, 1993

[54] PAPER FEED DEVICE

[75] Inventors: Kazuhiro Hirota; Izumi Hamanaka, both of Hachioji, Japan

[73] Assignee: Konica Corporation, Tokyo, Japan

[21] Appl. No.: 686,480

[22] Filed: Apr. 17, 1991

[30] Foreign Application Priority Data

Apr. 18, 1990 [JP] Japan ..... 2-102732
Apr. 18, 1990 [JP] Japan ..... 2-102733
Apr. 18, 1990 [JP] Japan ..... 2-102734

[51] Int. Cl.[5] ..... B65H 3/10

[52] U.S. Cl. ..... 271/11; 271/96; 271/103; 271/108; 271/110

[58] Field of Search ..... 271/5, 11, 96, 103, 271/108, 110

[56] References Cited

U.S. PATENT DOCUMENTS 4,284,270 8/1981 Silverberg .
4,324,395 4/1982 Silverberg .
4,345,751 8/1982 Holzhauser .
4,391,439 7/1983 Edstrom ..... 271/108 X
4,411,417 10/1983 Browne .
4,585,222 4/1986 Nishibori ..... 271/106
4,662,622 5/1987 Wimmer ..... 271/108 X

FOREIGN PATENT DOCUMENTS

0413471A2 8/1991 European Pat. Off. .
240785 3/1925 United Kingdom .
685810 1/1951 United Kingdom .

*Primary Examiner*—Richard A. Schacher
*Attorney, Agent, or Firm*—Finnegan, Henderson, Farabow, Garrett & Dunner

[57] ABSTRACT

A paper feed device and method for separating sheets of paper one by one from the bottom of a stack of paper loaded on a paper loading tray and for feeding the separated paper sheets consecutively. The feed device includes a rotatable hollow cylinder having a peripheral surface positioned below and close to the front end of the paper loading tray in the direction of paper sheet feed, and having an opening for drawing a paper sheet against the peripheral surface by vacuum suction. The vacuum suction is variable to set the suction pressure at the low level at the start of a paper sheet feed operation by the cylinder means, and if, after the predetermined time interval, the passage of the paper sheet is not detected, the vacuum suction pressure is increased to a higher level and maintained at the higher level to feed successive paper sheets. A paper sheet front end sensor, a conveyor, and a timer for setting a predetermined time interval after the start of a paper sheet operation, are also provided.

8 Claims, 13 Drawing Sheets

FIRST CYLINDER 311 ROTATION
SECOND CYLINDER 321 ROTATION
SIGNAL OF PHOTO SENSOR 264
TIMER MEANS 342
OPEN RATIO PROVIDED BY SECOND AND THIRD CYLINDERS
STATIC PRESSURE IN CYLINDER
NTH SHEET
(N+1)TH SHEET
FOLLOWING ROTATION
OFF
ON
OFF
ON
OFF
ON
OFF
ON
OFF
NO PAPER
PAPER
OFF
ON
OFF
(%)
100
0
SUCTION
H
L
0
A
B
C
D
E

PAPER FEED DEVICE

BACKGROUND OF THE INVENTION

1. Field of the Invention

The present invention relates to a paper feed device for a document conveyor used in an image recording device or a document image reading device for an electrophotographic copying machine and the like.

2. Description of the Prior Art

Conventionally, in an image recording device or a document image reading device, a recycling-type document conveyor (RDH) or an automatic document feeder (ADF) are used to convey documents consecutively and automatically onto a document loading tray (platen glass). In a double-sided copying device (ADU) by which a copy image is formed on both sides of a transfer sheet, a transfer sheet, on one side of which a copy has been formed, is temporarily stored in an interim stacker, after which a second paper is fed from the paper feed section and conveyed to an image forming section. With these devices the separating efficiency is extremely important.

Conventionally, a bottom feed method with superior separating efficiency has been adopted as a paper feed method. This method involves separating one document at a time from the bottom layer of a stack of paper loaded on a paper form stacker and conveying these documents consecutively to the handling section. After exposure, the document is returned to the paper form stacker or forwarded to a paper discharge stacker.

In a paper feed device which is a typical example of a recycling document conveyor (RDH) in which a bottom feed stacking system is used, a paper feed port is provided at the lower end of a paper loading tray for the paper feed device. One document sent forward from a first paper feed section adjacent to the paper feed port is passed through a first paper feed channel from a second paper feed section and introduced onto the top surface of the platen glass of a copying machine. The document is then moved to an exposure position by a conveyor belt provided on the platen glass, and in that position the exposure optical system is moved reciprocatingly to perform the exposure operation. The exposed document is once again fed by the operation of the conveyor belt, passes through a recycling channel, and is fed to the top position of a stack of documents on the paper loading tray.

In this conventional paper feed device, the first paper feed section comprises a paper feed belt which sends forward the document on the bottom of a stack of documents in the paper feed position, and a stopper roller which stops the movement of the document by applying pressure against the paper feed belt. However, with this device, when the documents aligned on the document stacker are pressed forward by a pressure belt to the paper feed position, several documents at one time move into a wedge-shaped section formed by the paper feed belt and the stopper roller and then are thrust into a nip section.

Furthermore, there are several problems produced which cause concern, such as image distortion and the like caused by soiling and chafing of the top and bottom surfaces of the document from the friction on each surface by the adjacent documents, resulting from the pressure applied by the stopper roller to the paper feed belt.

In particular, in recent years copying machines featuring high speed conveying of documents and transfer sheets, and higher paper feed stability are in demand, and a paper feed device which can convey papers of all qualities and weights is required.

A paper feed device disclosed in U.S. Pat. No. 4,345,751 comprises a means to apply a negative pressure through a plurality of through-holes provided in an endless belt for a paper feed device which feeds a document from the document loading tray to the platen glass, and an eccentric suction drum capable of a rocking motion. In this proposal, no movable document stopper is used for the document conveying device, but the documents are fed from the document loading tray to a document stop position on the opposite side of the platen glass and aligned.

With this type of multi-strand endless belt there is a tendency to produce variations in speed between the individual strands of the belt, and, as a result, distortions are produced in the paper which is being fed. If this sort of distortion is not removed prior to making the copy, an accurate copy of the image on the document is not formed on the transfer sheet. Additional drawbacks are that the construction and operation of the paper feed device is complicated. In particular, the rocking mechanism of the suction drum is complicated, and the device becomes very large.

Another conventional technology provides a paper feed device with ribs projecting from the top surface of the document loading tray, a suction box on the bottom surface, and a blower downstream from the document loading tray. Close to the center of the stack of documents on the loading tray a wave shape is formed in the document by the projecting ribs, and at the front end of this wave-shaped document an air blast from the blower is directed between the documents, and the suction from the suction box causes the documents at the bottom of the stack to be separated one at a time and fed out. (U.S. Pat. Nos. 4,284,270, 4,324,395, and 4,411,417).

However, with the paper feed device using this air knife handling method, the following problems occur.

(1) It is difficult to make the shape of the suction box conform to many different sizes of documents because the surface of the document loading tray is deformed;

(2) lead time is necessary because of the suction from the air gap. This is unsuitable for high speed paper handling;

(3) a special blower is necessary, control is complicated, and the cost is high; and (4) because it is necessary to turn the negative pressure in the suction box on and off with a valve, extra suction time (for example, several hundred milliseconds) is inevitably produced so that there is some degree of restriction on high speed operation, and the like.

With the abovementioned bottom-feeding paper feed device, it is usually difficult to provide a stable paper feed to conform to changes in the paper size, paper quality, paper weight (thickness), and the number of sheets stacked on the paper loading tray, and the like. This is because it is difficult to control the suction pressure of the vacuum suction device with respect to the factors that produce conformity to the abovementioned various paper characteristics.

For this reason, the presently available paper feed devices are usually restricted to feeding a single document size or a document size of similar dimensions.

Also, with conventional paper feed devices, a special switching button is provided for feeding thick paper forms (corresponding to 70 to 110 kg paper), and the operator must press the button to change the setting and increase the suction pressure. However, when feeding light paper (corresponding to 40 to 45 kg paper and tracing paper) the suction pressure cannot be lowered, so that there is a tendency for the corners of the papers to be bent, or for creases to be produced in these papers.

SUMMARY OF THE INVENTION

An object of the present invention is to provide, with due consideration to the drawbacks of such conventional devices, a paper feed device which prevents the production of spots or stains on the surface of the document and distortion of the image, or the like.

A further object of the present invention is to provide a bottom feeding paper feed device which can convey a paper of any quality or weight in a stable manner.

A still further object of the present invention is to provide a paper feed device whereby a stable paper feed is possible at the optimum suction pressure for various sizes, various weights, and a wide range in the number of sheets in the stack.

These objects are achieved in the present invention by the provision of a paper feed device for separating sheets of paper one by one from the bottom of a stack of paper loaded on a document loading tray and for feeding the separated papers consecutively, characterized by a triple-cylinder suction mechanism comprising a rotatable pipe-shaped first cylinder, positioned below and close to the front end of the document loading tray in the feed direction, and provided with a large number of small through-holes on its peripheral surface; a pipe-shaped second cylinder, positioned inside the first cylinder and provided with a slotted opening in its peripheral surface; a pipe-shaped third cylinder, positioned inside the second cylinder and provided with a slotted opening in its peripheral surface; and a suction device combined with the third cylinder; wherein one of the second and third cylinders is held stationary and the other is rotatable.

In addition, in the paper feed device of the present invention the auxiliary suction port is disposed in such a position as to be half-covered by the end of the paper which has been separated and held tightly against the peripheral surface of the first cylinder by the application of suction.

These objects are further achieved in the present invention by the provision of a paper feed device for separating sheets of paper one by one from the bottom of a stack of paper loaded on a document loading tray and for feeding the separated papers consecutively, comprising a rotatable hollow cylindrical cylinder means provided with an opening and positioned below and close to the front end of the document loading tray in the feed direction; a vacuum suction means, combined with the first cylinder means for varying the vacuum suction pressure; a paper front end sensor positioned downstream of the cylinder means; a conveyor means for interposedly supporting the paper sent forward from the cylinder means and conveying the paper to a subsequent handling section; a timer means for setting a predetermined time in response to the start of the cylinder means; and a control means for controlling the paper conveying operation of the conveyor means in such a manner that said vacuum suction means is set at its lowest vacuum suction pressure at the time of starting the paper feed operation of the cylinder means, and after the predetermined time from the start of the paper feed operation set by the timer means has elapsed, if the paper front end detector has not detected the passage of the front end of the paper, the vacuum suction pressure from the vacuum suction means is successively increased to slightly higher pressures and the paper feed operation is repeated, and as long as the paper front end detector detects the passage of the front end of the paper form, the vacuum suction pressure is maintained at that pressure.

BRIEF DESCRIPTION OF ACCOMPANYING DRAWINGS

These and other objects, features, and advantages of the present invention will become more apparent from the following description of the preferred embodiments taken in conjunction with the accompanying drawings, in which.

DETAILED DESCRIPTION OF THE PREFERRED EMBODIMENTS

The preferred embodiments of the paper feed device of the present invention will now be explained with reference to the drawings.

The embodiments described below are applied to a recycle-type document conveying device (RDH) which recycles and conveys a document. In addition, the present invention is not restricted to the following embodiments which are given for illustration only, but can be used with an automatic document feeder (ADF), a document reading device, and a double-sided copying device (ADU).

Figure 1:
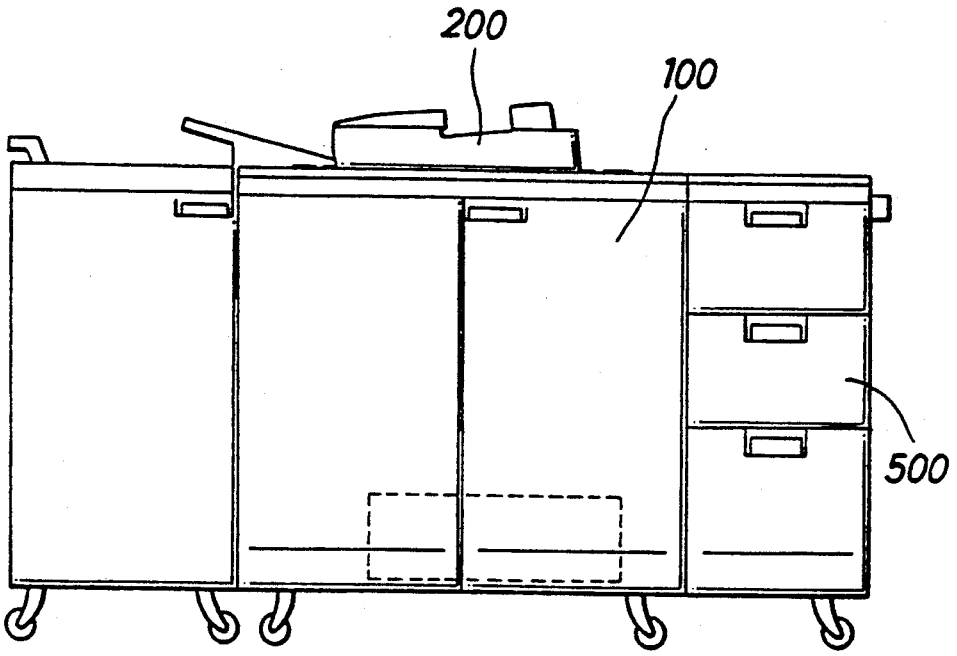
FIG. 1 is an overall view of one example of an image recording device on which is mounted a recirculating-type document conveying device using a paper feed device of the present invention.

Now referring to FIG. 1, a recycle-type document conveying device (RDH) 200 used with a paper feed device of the present invention is mounted on a main body 100 of a copy machine. A paper feed unit 400 for feeding copying paper, and a copy handling device 500 for binding or punching holes in the copy on completion of the copying process are also provided.

Figure 2:
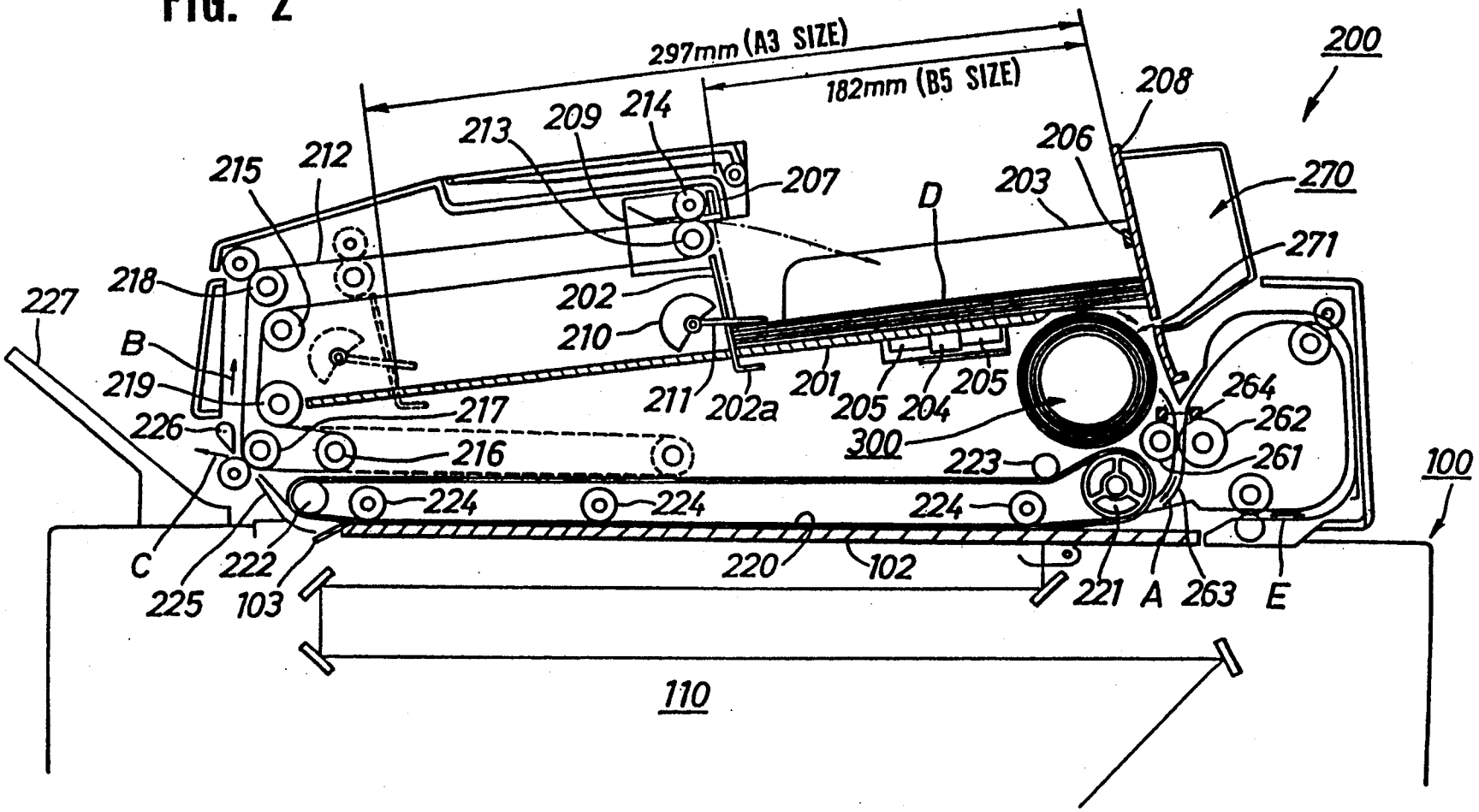
FIG. 2 is a front sectional view of a document conveyor using the paper feed device of the present invention.

FIG. 2 is a front sectional view of the recycle-type document conveying device 200 provided with the paper feed device of the present invention, which is installed on the main body 100 of the copy machine.

The recycle-type document conveying device 200 is provided with a document stacker 201 in which the front section downstream in the document conveying direction is raised in the forward direction (corresponding to the paper loading tray). A back end regulating plate 202 for contacting the back end of the document, and a width regulating plate 203 for regulating the document D in the lateral direction when a document D is set on the document stacker 201 are also provided. At the bottom surface of the document stacker 201, the width regulating plate 203 is connected alternately to a pair of rack gears 205, 205 respectively which can slide in the lateral direction and between which a pinion gear 204 is interposed, and by sensing the movable position of the width regulating plate 203 by means of a sensor (omitted from the drawing), symmetrically movable around the centerline of the width of the document, the width of the document D is read out. In addition, the back end regulating plate 202 can press the front end of the document D which is set on the document stacker 201 as far as the sensed position (fixed position) of a document stopper 208 and a stack sensor 206. The document stopper 208 is positioned close to a paper feed port in the paper feed direction of the document stacker 201 and is secured to a frame member in the paper feed section.

A blower means 280 is provided on the reverse surface of the document stopper 208. Air is blown through a bottom blower port 271 to assist in separating the documents.

A document setting sensor 207 for sensing whether or not the document D is set on the document loading tray 201 is provided. The sensor 207 is installed on an upper stage transfer member 209 at the upper front part of the back end regulating plate 202, and is formed so that it can move integrally with the plate 202.

The sensor 207, in any of the cases where the document D is halted at its original position on the document stacker 201; where the back end of the document D is pushed to slide onto the document stacker 201; and where the front end of the document D reaches the paper feed starting position, can optically sense whether or not the document D is set on the document stacker 201. When the document D is not set on the document loading tray 201, the sensor 207 can prevent a copy from entering the copying operation and being wasted.

The document setting sensor 207 is secured to a discharge paper port guide plate on the upper stage transfer member 209 so that its front section projects forward. At the bottom surface of the front end of the frame member on which the sensor 207 is mounted, a penetrating hole is formed, and the light projected from the inside of the frame of the sensor 207, and the light reflected to the sensor 207 passes through the penetrating hole in the frame member. The sensor 207 is provided in the same frame as a light emitting section and a light receiving section, formed from a light emitting diode and a phototransistor respectively. The light beam projected from the light emitting section (LED) passes through the penetrating hole in the frame to a reflection plate **202*a* which projects forward and is integrally formed from the bottom edge of the back end regulating plate 202 and is integrally formed with the back end regulating plate 202. The beam reflected from the reflection plate 202*a*** once again passes through the frame penetrating hole to the light receiver (phototransistor).

The back end regulating plate 202 and the document setting sensor 207 are mounted on the upper stage transfer member 209, and in addition, a document classifying device (set separator) 210 is integrally suspended from the transfer member 209 close to its center.

In the above-described recycle-type document conveying device it is essential to detect the recycling of the documents. For this reason, a previously positioned dividing arm (selector) 211 on the document classifying device 210 is set on the uppermost document of a stack of documents loaded onto the document stacker 201. The documents in the once-cycled stack are consecutively loaded onto the upper section of the dividing arm 211. At the point where the final document to which pressure is applied by the dividing arm 211 is fed to the exposure position, the dividing arm 211 is removed from the document loading position, and when the final page is returned to the document loading table and is loaded in the uppermost position of the document stack, the dividing arm 211 applies pressure to the uppermost sheet of the document stack.

In addition, the upper side of an end roller 213 which is rotated by means of a paper discharge belt 212, and a follower roller 214 which rotatingly follows when pressure is applied, are axially supported on the upper stage transfer member 209. The paper discharge belt 212 is stretched so that the rear side of the document stacker 201 is rolled up into a C shape by means of a drive roller 215 which is connected to a main motor through a unidirectional control mechanism, an upper side end roller 213 axially supported so that it can move horizontally along the upper and lower surfaces of the document stacker 201, a lower side end roller 216, and a group of auxiliary rollers 271, 218, 219. By the rotation of the drive roller 215 in a fixed direction, the document D sent out from the conveyor belt is conveyed in the paper discharge direction.

A conveyor belt 220 is provided for conveying the document D in both the forward direction and the reverse direction on the top surface of the platen glass 102. The conveyor belt 220 is stretched between a first roller 221 connected to the main drive motor through a forward/reverse switching means, and a second roller 222 on the paper discharge side. A tension roller 223 applies pressure to the upper side of the belt surface from the first roller 221, and the lower side belt surface is caused to slide along the surface of the platen glass 102 by a plurality of presser rollers 224, 224, 224.

The first roller 221 and the second roller 222 are linked together by a timing belt which has been omitted from the drawings. The conveyor belt 220 is operated by the driving force from the first roller 221 when it moves in the forward direction (the clockwise direction in FIG. 2), and the lower belt surface becomes the slack side. In this case, the second roller 222 slides with respect to a unidirectional clutch. In addition, in the case where the conveyor belt 220 runs in the reverse direction (the counterclockwise direction), the unidirectional clutch becomes locked and the second roller 222 becomes the drive side of the conveyor belt 220. Specifically, the conveyor belt 220 can be operated with the first roller 221 as the drive side, or with the second roller 222 as the drive side. This is particularly effective when the document D is running on the platen glass 102 where synchronous exposure is performed.

A document stopper 103 is provided at the paper discharge end of the platen glass 102 and is provided with an action allowing it to protrude from or recede into the platen glass 102. The document stopper 103 recedes into the platen glass 102 when the document D is being conveyed in the document recycle copy mode by the conveyor belt 220 at the synchronous exposure speed on the platen glass 102, whereby an optical exposure system 110, which can be secured at a fixed position directly under the platen glass 102 or can move, implements the exposure and forms an image on a photosensitive drum body. In the case where, in the automatic document feeder (ADF) mode or in the semiautomatic document feeder (SDF) mode, the document is halted at the exposure position on the platen glass 102, and is exposed with the optical system 110 moving so that an image is formed on the drum, the document stopper 103 is moved so that it protrudes from the top of the platen glass 102.

A paper discharge guide plate 225 is provided which is a continuation of the discharge port side of the platen glass 102. A switching finger 226 is provided which switches the document between a recycle paper discharge channel B leading to the document stopper 201 and an external paper discharge channel C leading to an external paper discharge tray 227, part way along the paper discharge guide plate 225. When the back end regulating plate 202 returns to the home position it opens the external paper discharge channel C, and when the back end regulating plate 202 is not at the home position it opens the recycle paper discharge channel B.

A channel E is provided for reversing the document when both sides are to be copied. The document D is reversed in somersault fashion in the channel E, then again conveyed onto the platen glass 102.

A suction cylinder device 300 is provided for separating the documents one at a time from the document stack, which is in a fixed position, and feeding the documents onto the platen glass 102.

Figure 3:
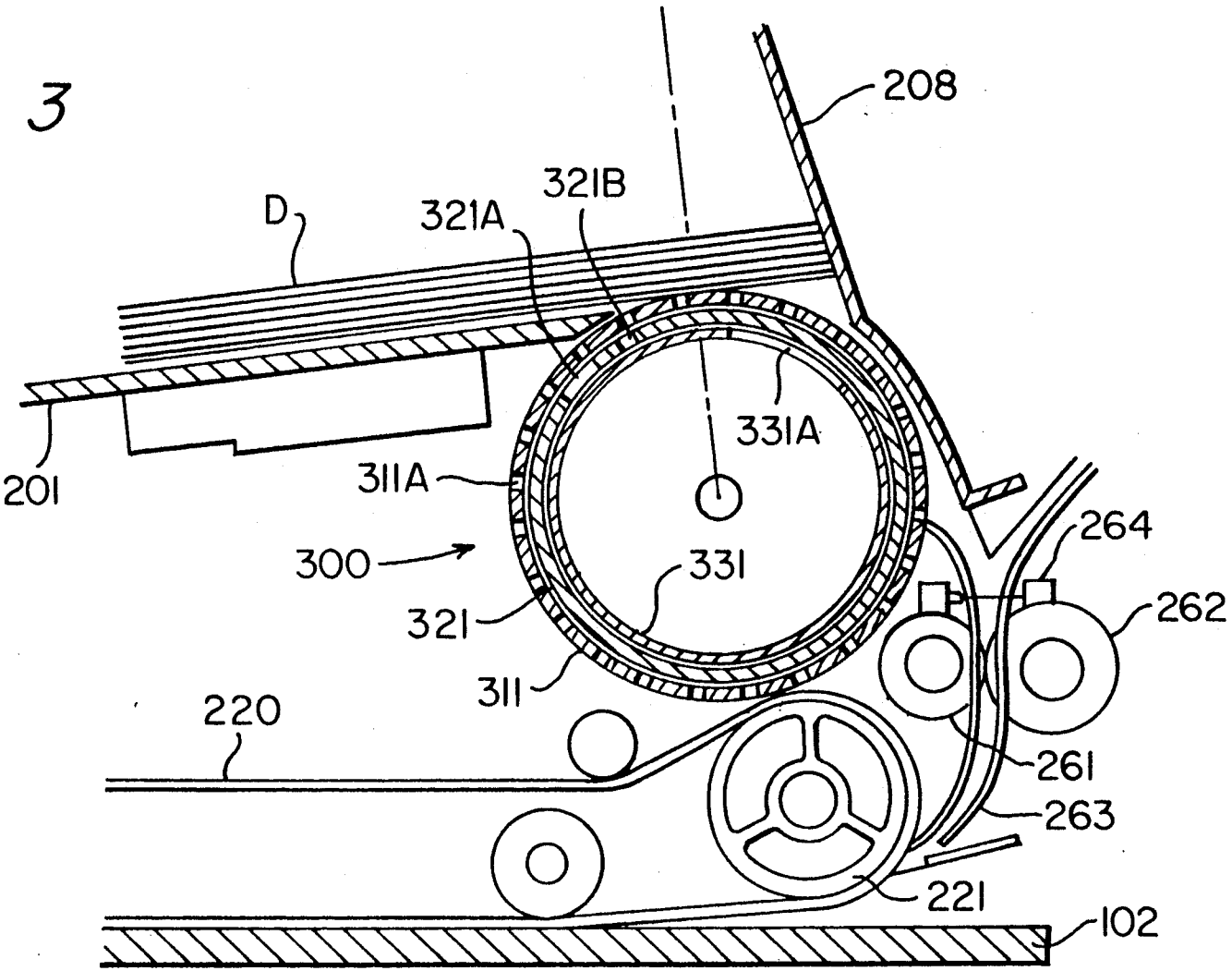
FIG. 3 is a front sectional view of the principal parts of an embodiment of the paper feed device of the present invention with a suction cylinder device.
Figure 4:
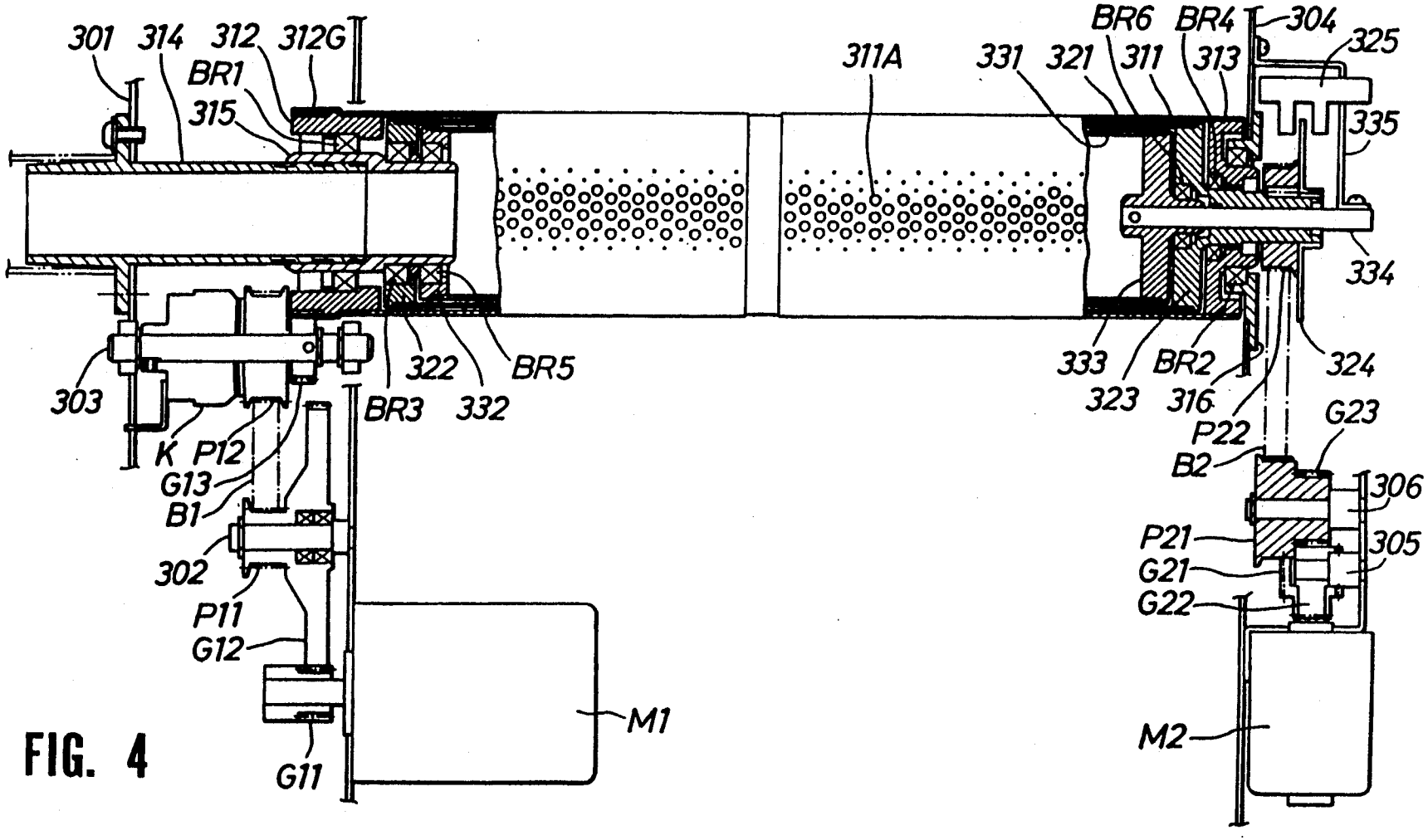
FIG. 4 is a sectional plan view of part of the suction cylinder device shown in FIG. 3.
Figure 5:
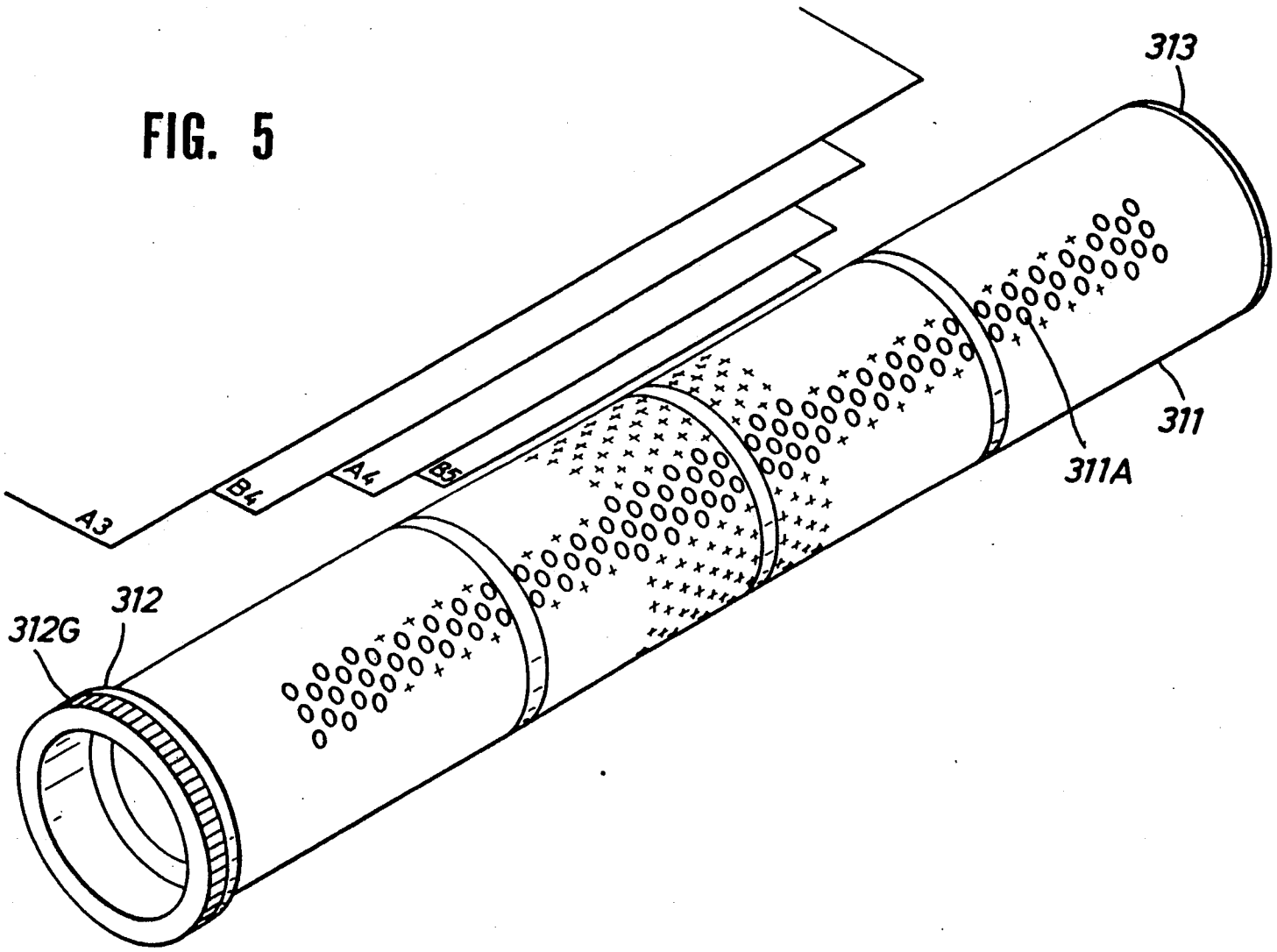
FIG. 5 is a perspective view of the outer cylinder member of the cylinder device.
Figure 6:
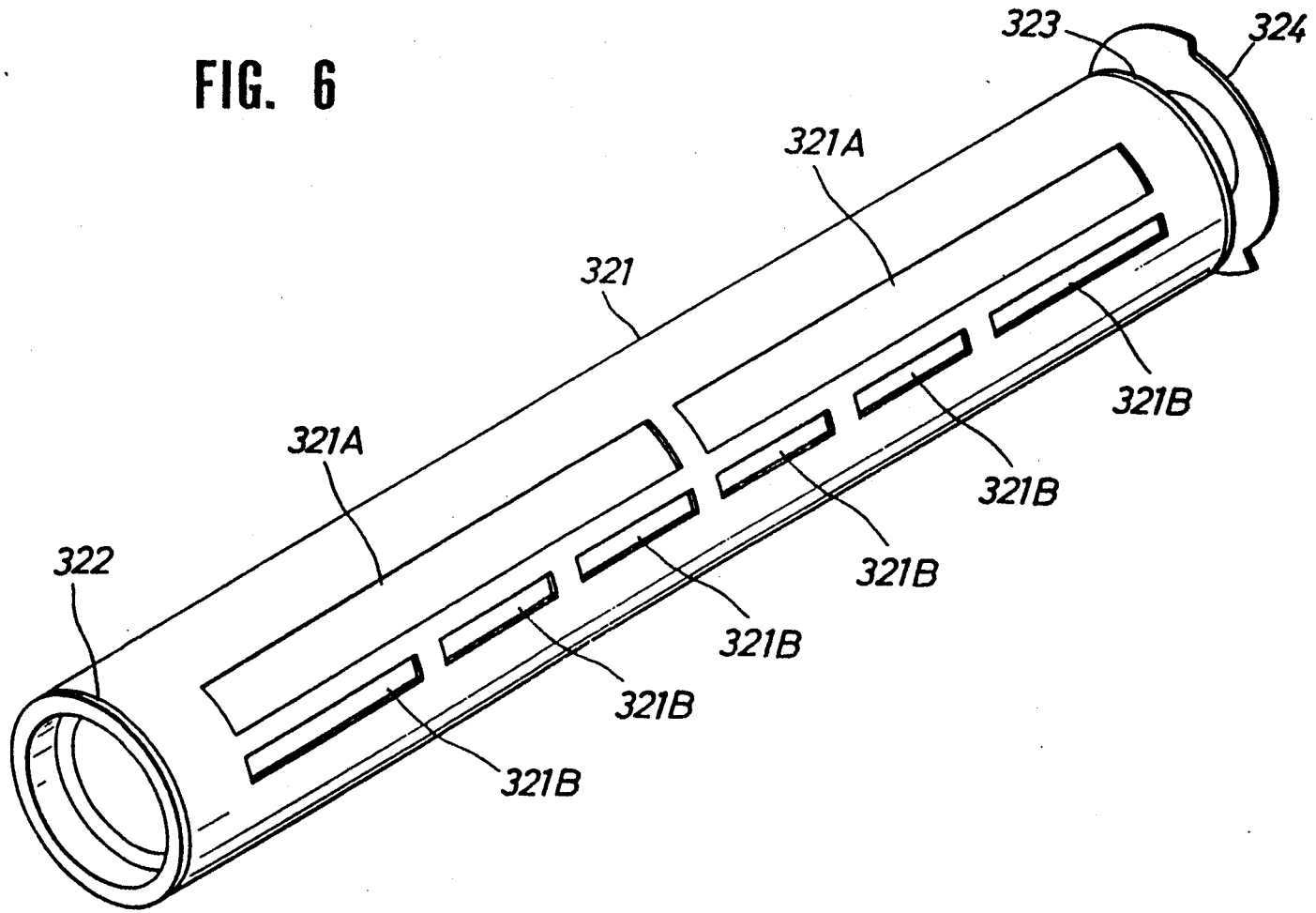
FIG. 6 is a perspective view of an intermediate cylinder member.
Figure 7:
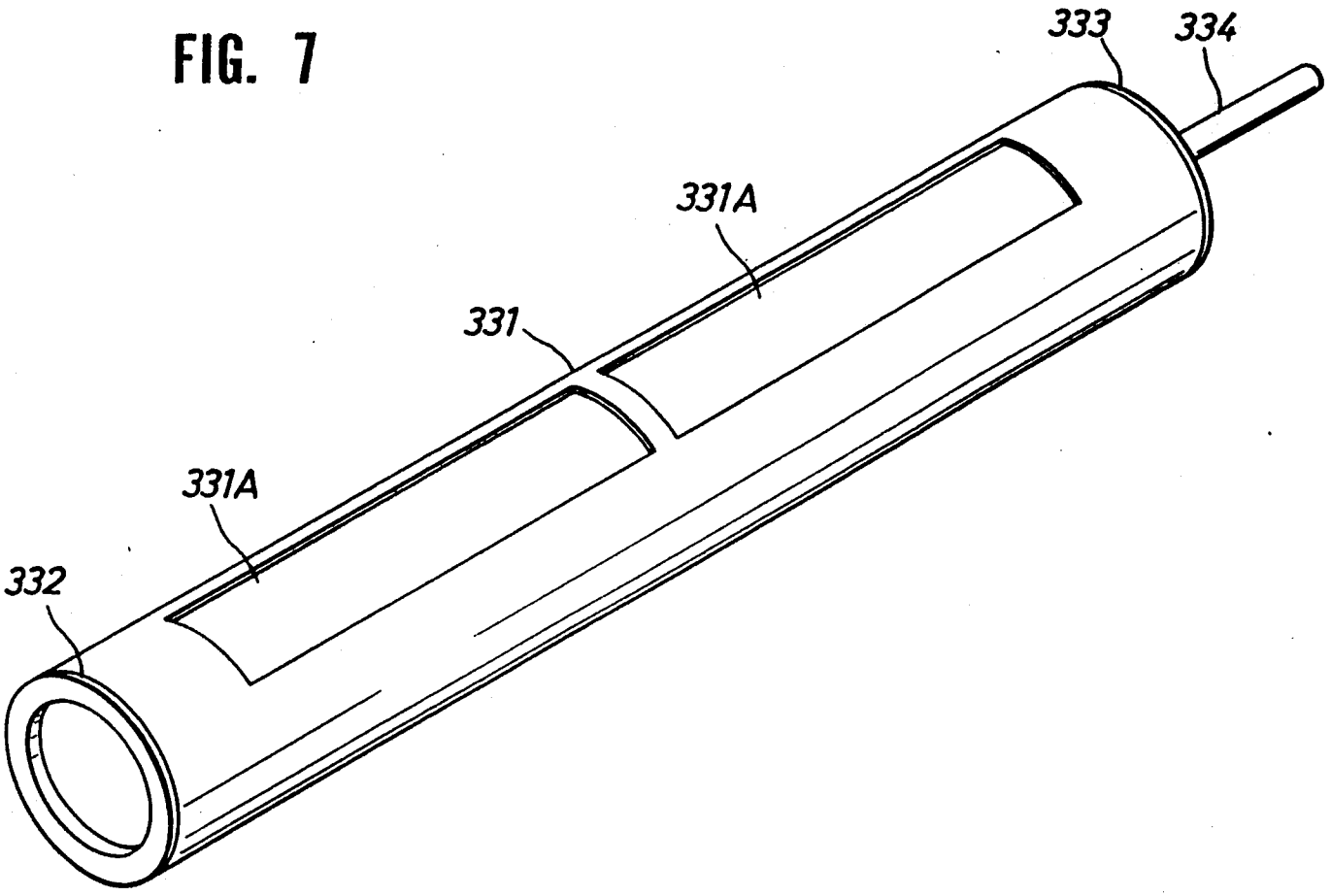
FIG. 7 is a perspective view of the inner cylinder member of the cylinder device.

FIG. 3 is a front sectional view showing one embodiment of the paper feed device of the present invention with a suction cylinder device. FIG. 4 is a sectional plan view of part of the suction cylinder device 300. FIG. 5 is a perspective view of the outer cylinder member of the cylinder device. FIG. 6 is a perspective view of an intermediate cylinder member. FIG. 7 is a perspective view of an inner cylinder member of the cylinder device.

The cylindrical device 300 comprises an outer cylinder member (first cylinder) 311, an intermediate cylinder member (second cylinder) 321, an inner cylinder member (third cylinder) 331, and a drive means for rotatingly driving the cylinder members.

The outer cylinder member (first cylinder) 311 is made from a thin-walled cylindrical aluminum alloy pipe, one millimeter thick or less. A plurality of small diameter through-holes 311A perforate the outer peripheral surface of the outer cylinder member 311, and the outer peripheral surface is covered with synthetic rubber. The diameter of the small diameter through-holes 311A is in the 3 to 10 mm range, and the through-holes 311A are arranged in a regular grid or in a zig-zag shape. The intermediate cylinder member 321 is a thin-walled cylinder with a plurality of small openings formed by a nickel electroplating process or a stainless steel thin-plate etching process. It is also possible to fabricate the thin-walled cylinder in nickel by an electroforming process using the outer blade of a power shaver. If this electroforming process is used, the thin-walled cylinder with a wall thickness of 1 mm or less, for example 0.1 mm, with a plurality of small openings perforating the walls, can be constructed at low cost and with high precision, with a well-finished surface free of any burrs or damage. As an alternative, the thin-walled cylinder with a plurality of small openings can be formed as a thin-walled cylinder with a stainless steel plate surface, and the plurality of small holes formed by etching.

The surface of the thin-walled cylinder with a plurality of small openings fabricated in this manner must have a high friction factor suitable for adsorbing and transporting the paper, therefore its surface is roughened and it is coated with synthetic resin. In addition, the material and the film layer of this cylinder are formed of a material with superior characteristics with respect to strength, flexible return, heat resistance, low temperature resistance, abrasion resistance, oil resistance, adhesion, and the like.

The synthetic rubber coating on the surface of the drum is a material with a high friction factor and superior characteristics with respect to strength, heat resistance, low temperature resistance, abrasion resistance, oil resistance, adhesion, and the like. Examples of such a material are ethylene propylene rubber (EPDM), chloroprene rubber, urethane rubber, styrene rubber, acrylic rubber, butyl rubber, butadiene rubber, silicone rubber, fluorine rubber, and the like, formed as a uniform coating by painting or spraying.

A pair of flanges 312, 313 are integrally fitted, one at each end of the outer cylinder member 311, corresponding to the inner diameters of the openings.

A bearing BR1 is securely fitted into the flange 312 corresponding to the inner diameter of the opening of the flange 312. The bearing BR1 is linked to a suction tube 314 which is mounted on a side plate 301 and supported in a freely rotatable manner on the outer wall of a suction connection tube 315 which is fitted into the bearing BR1.

The suction tube 314 is connected to a suction means, for example, a suction pump 340, through a suction tube 343, and provides air to the triple-cylinder assembly 311, 321, 331 of the suction cylinder device 300.

The suction pressure in the suction means 340 can be varied by a control means 341, through, for example, a range from a minimum of 200 mm Hg to 400 mm Hg, in stages or continuously.

The suction pressure is raised and lowered corresponding to a predetermined time set by the control means 341 or by a timer means 342.

A gear 312G is integrally formed on a section at the external diameter of the flange 312. The rotation of a pinion gear G11, which is driven by a motor M1, causes a gear G12 on a first countershaft 302 and a toothed pulley P11 to rotate. In addition, the rotation of the pinion gear G11 causes a gear G13 and a toothed pulley P12 connected to a clutch K on a second countershaft 303 to rotate via a toothed belt B1, and also causes the rotation of the gear 312 G secured to one end of the outer cylinder member 311, engagingly driven by the gear G13.

Simultaneously, the toothed belt B1 causes a pair of intermediate conveyor rollers 261, 262 to rotate via a third countershaft (omitted from the drawings, but identical in shape to the second countershaft) (see FIG. 3). A guide plate 263 and a document front end sensor 264 are also provided.

A bearing BR2 is securely fitted onto a section at the outer diameter of the boss of the flange 313 on the other end of the outer cylinder member 311, and the bearing BR2 is fitted into and supported by a support member 316 which is mounted on a side plate 304. Accordingly, both ends of the outer cylinder member 311 are supported in a freely rotatable manner on the side plates 301, 304. Then, one document at a time is intimately held against the cylindrical surface of the outer cylinder member 311 by suction from the small diameter through-holes 311A, without conveying, and the drive rotation is stopped.

Next, the intermediate cylinder member (second cylinder) 321 is formed, for example, from a thin-walled cylindrical aluminum alloy pipe. On one part of the external peripheral surface, a pair of rectangular main suction ports 321A with a large open area, and six rectangular secondary suction ports 321B with a small open area are formed. The angle of the openings of the main suction ports 321A is set at 15° to 30°, while the angle of the openings of the secondary suction ports 321B is set at 5° to 15°.

The intermediate cylinder member 321 can also be fabricated in cylinder form using a hardened resin process, or as a cylinder made from a paper tube covered within resin.

The spacing g between the outer peripheral wall of the cylindrical surface of the intermediate cylinder member 321 and the inner peripheral wall of the cylindrical surface of the outer cylinder member 311 is set and maintained at 1 mm or less, and preferably 0.7 mm or less.

Because the outer cylinder members 311 is fabricated as a thin-walled cylinder and can be flexibly deformed, when a localized loading is applied to the outer cylinder member 311 causing deformation, the spacing g between the intermediate cylinder member 321 and the outer cylinder member 311 becomes smaller, and the thick wall of the intermediate cylinder member 321, which has rigidity, backs up and resists the deformation of the outer cylinder member 311. Both cylinder members are supported in a slideable manner, so that no permanent distortion is produced in the outer cylinder member 311 and when the external stress is removed it returns elastically to its original shape. Furthermore, as the spacing g decreases, the air suction efficiency from the ports 321A, 321B increases, and the paper adsorption performance improves. Specifically, the air leaking from the spacing g is minimized.

Conversely, if the spacing g between the two cylinders becomes too large, not only does the air leak increase and the suction force drop, but when a localized load is applied to the outer cylinder member 311 an undesirable condition results, inasmuch as the cylindrical surface of the outer cylinder member 311 is easily deformed and permanent distortion is produced or damage occurs.

It is difficult to fabricate the cylindrical surface of the outer cylinder member 311 with precision so that it is perfectly round over the entire surface. In addition to this problem, it is extremely difficult to maintain a small spacing g between the two cylinder members. This spacing g should be 1 mm or less, and preferably from 0.3 to 0.7 mm, and by making this cylinder elastic and flexible, these problems are alleviated and the suction efficiency is improved. Also, when localized strain is applied to the outer cylinder member 311 and it slides on the intermediate cylinder member 321, the friction resistance is low and the motor load is low because of the flexible return characteristics of the material.

The flanges 322, 323 are fitted into the two open ends of the intermediate cylinder member 321 and integrally secured.

The bearing BR3 is securely fitted into the inner diameter section of the flange 322, against the outer peripheral surface of the suction connecting tube 315 and supported in a freely rotational manner.

A bearing BR4 is securely fitted onto a section at the outer diameter of the boss of the flange 313, and the flange 323 is supported in a freely rotatable manner on the flange 313 by engaging the flange 313 through the bearing BR4.

A toothed pulley P22 and a cam plate 324 are secured near the front end of the boss section of the flange 323. The drive rotation of a pinion gear G21 from the motor M2 causes through a gear G22 loosely fitted on the first countershaft 305, a gear G23 loosely fitted on a second countershaft 306, and a toothed pulley P21 to rotate, thus causing the toothed belt P22 to rotate via a toothed belt B2.

The cam plate 324 controls the rotation of the intermediate cylinder member 321 by opening and closing the optical path of the photointerrupter (transparent optical coupling element) 325.

The intermediate cylinder member 321 operates a shutter which applies suction and separates the documents by means of the suction from the main suction port 321A and the secondary suction ports 321B of the intermediate cylinder member 321, and halts the driving rotation. Therefore, for every rotation one document is conveyed and the rotation is halted.

Next, the inner cylinder member (third cylinder) 331 is formed, for example, from a thin-walled cylindrical aluminum alloy pipe. Two rectangular suction ports 331A, 331A are formed on one part of the external peripheral surface. The open angle of the suction ports 331A is set at 30° to 60°.

Two flanges 332, 333 are fitted into the two open ends of the inner cylinder member 331 respectively and integrally secured.

The flange 332 is supported in a freely rotational manner against the outer peripheral surface of a suction connecting tube 336, through a bearing BR5 in the same manner as the flange 322.

The boss of the flange 333 is supported in a freely rotational manner on the flange 323, through a bearing BR6, and a fixed shaft 334 is secured to the boss of the flange 333. The fixed bearing 334 is loosely inserted into the boss of the flange 323, and the projecting right end of the bearing 334 is secured to a support plate 335 which is in turn secured to the side plate 304.

Figure 8A:
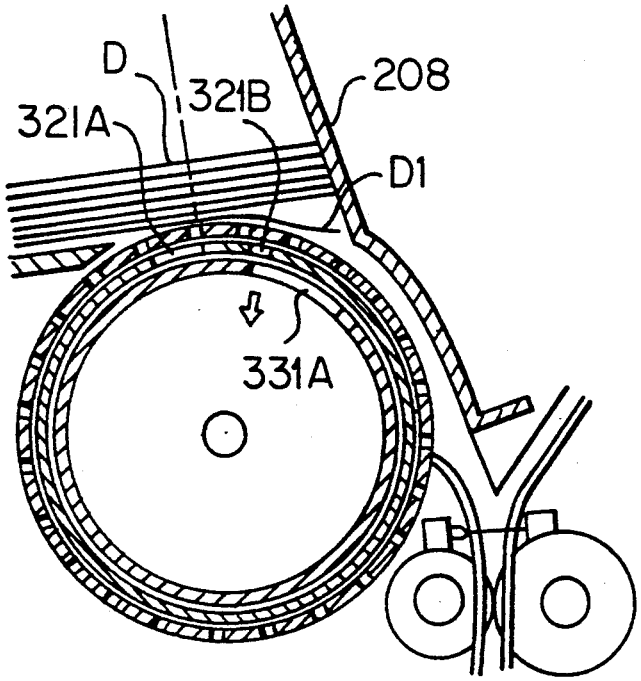
FIGS. 8A to 8D are sectional views for explaining the paper feed process.

Next, the operation of the recycling-type document conveyor (RDH) provided with the paper feed device of the present invention will be explained, based on the sectional view of the paper feed device shown in FIG. 3, the sectional views of the suction cylinder device shown in FIG. 8A to FIG. 8D, the structural views shown in FIG. 9A and FIG. 9B, the timing chart of FIG. 10, and the flow chart of FIG. 11.

(1) The documents are stacked, copy side up, on the document stacker 201 with the back ends touching the back end regulating plate 202 at the home position, with the pages arranged in order.

(2) The documents are adjusted in the direction of their width by means of the width regulating plate 203. This determines the size of the documents, which is input to memory (a document size-determination means 228).

(3) The number of copies to be made is input and the copy button depressed.

(4) The document setting sensor 207 detects and confirms the presence or absence of a document, the document classifying device (set separator) 210 is rotatingly activated, and the device enters a paper feed standby condition. FIG. 3 shows the condition immediately prior to the start of suction. In this condition, the main suction port 321A and all the secondary suction ports 321B of the intermediate cylinder member 321 are halted on the paper feed upstream side of the point of contact of the document stack and the outer cylinder member 311. The suction port 331A of the inner cylinder member 331 is positioned on the paper feed downstream side of the abovementioned point of contact, and the intermediate cylinder member 321 and the inner cylinder member 331 are halted in a configuration in which the ports are mutually closed.

(5) Next, a drive source M4 for the paper discharge belt 212 is started, and the upper side end roller 213, bearingly supported on the upper stage transfer member 209, is moved in the forward direction of the paper feed, while the lower side end roller 216, bearingly supported on a lower stage transfer member, is moved in the rear direction of the paper feed. The back end regulating plate 202 mounted on the upper stage transfer member 209 is advanced while pressing against the back end of the document D, and when the pressure of the front end of the document D against the document stopper 208 is detected by the stack sensor 206, the drive source M4 is halted by the action of the control means 219 (see FIGS. 9A and 9B). At this time, at a position close to the front end of the stack of documents, an overhang is produced at the point of contact with the outer cylinder member 331, and this overhang is unsupportedly maintained in a projecting state by the stiffness of the paper (see FIG. 3).

(6) Next, the suction means 340 of the suction cylinder device 300 is turned ON, and the negative pressure from the suction source ia applied to the inside of the inner cylinder member 331 through the suction tube 314 and the suction connection tube 315. Simultaneously, a blower means 270 is also turned ON, and pressurized air is blown from the blower port 271, and directed onto the outer peripheral surface of the outer cylinder member 311 of the suction cylinder device 300. However, because the outer cylinder member 311, the intermediate cylinder member 321, and the inner cylinder member 331 are all halted and the ports 321A, 321B, 331A are not in alignment, as shown in FIG. 3, no through passage exists and the document D cannot be subjected to vacuum (FIG. 10A).

(7) The intermediate cylinder member 321 is driven by the motor M2. First, the secondary suction ports 321B are rotated in the clockwise direction, the corresponding opening angle formed by the open section of the immobilized inner cylinder member 331 gradually widens, and the open ratio increases (see FIG. 8A). At this time the outer cylinder member 311 is halted. As the open ratio increases, negative pressure from the suction means 340 is applied to the base of the lowermost document D1 in the stack of documents, through the secondary suction ports 321B, the main suction port 331A, and the small-diameter through-holes 311A, and the lowermost document D1 is adsorbed and peeled away from the point of contact with the peripheral surface of the outer cylinder member 311, adhering to the peripheral surface of the outer cylinder member 311.

The suction from the suction means 340 during the abovementioned adsorption and peeling away is set at a vacuum pressure which can convey but not damage sheets of light paper (tracing paper or the equivalent of 40 to 45 kg paper). This vacuum pressure is about 200 mm Hg, for example, as a test value.

Figure 8B:
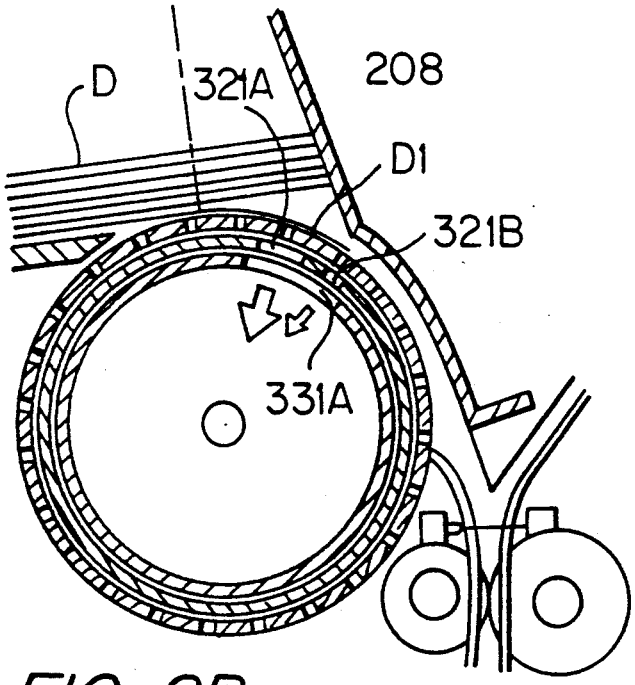
Figure 9A:
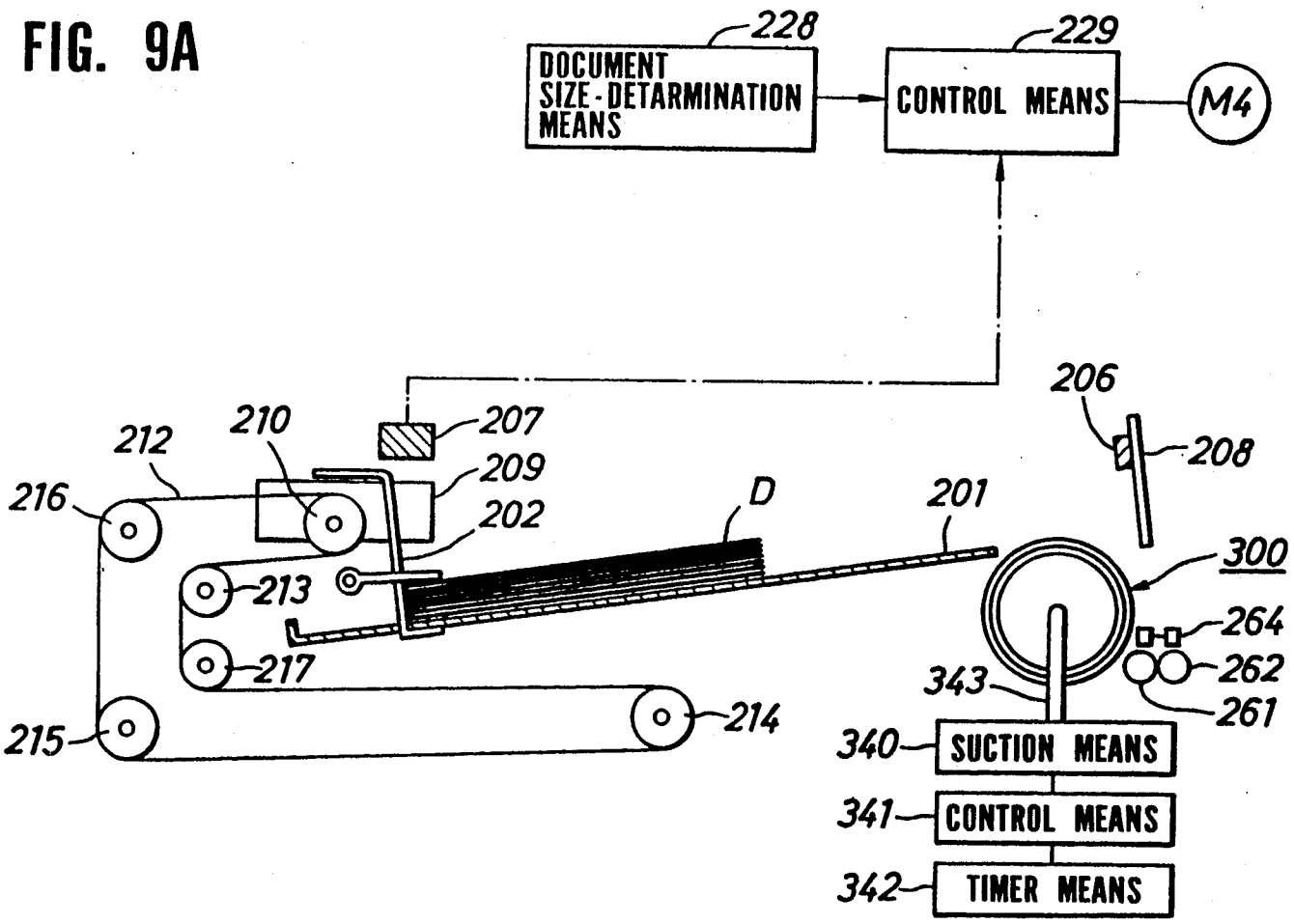
FIG. 9A and FIG. 9B are views showing the structure of a recycle-type document conveying device.
Figure 9B:
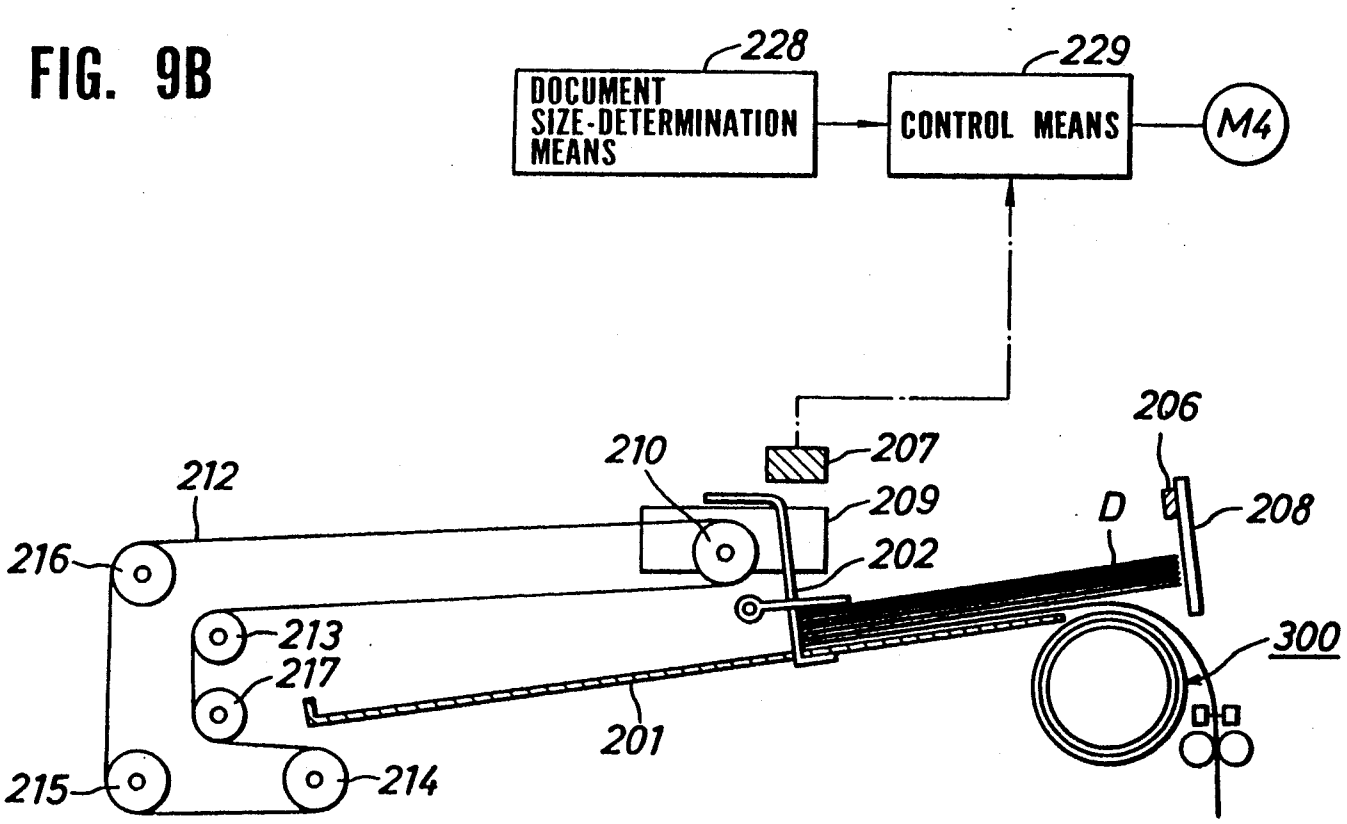

(8) The intermediate cylinder member 321 is once more rotatingly driven, and the main suction port 321A and the secondary suction ports 321B line up with the suction port 331A in a fully open condition (FIG. 8B, open ratio 100%). When this condition is detected by the photointerrupter 325, the driving rotation of the intermediate cylinder member 321 is halted. At this time the document D1 is adsorbed by suction applied through the ports 321A, 321B, 331A, and the small diameter through-holes 311A, and adheres closely to the outer peripheral surface of the outer cylinder member 311. The document D1 in this closely-adhering state covers and seals the main suction port 321A, and because the front end of the document D1 is in a position which half-covers the secondary suction ports 321B, the tight closure of the secondary suction ports 321B is terminated close to the front end of the document D1 so that the negative pressure is released and the suction force on the document D1 is reduced to a force which is less than when the peeling-off of the sheet commenced. At this time, the documents second and third from the bottom of the stack which are adhering to the bottom document D1 as a result of the strong suction force at the tightly sealed ports, are separated as a result of the reduced negative pressure produced at the secondary suction ports 321B, and they are returned to the original position from the inherent strength of the paper. Therefore only the bottom document D1 remains adhering closely to the surface of the outer cylinder member 311. At this time, the pressurized air from the blower device 270 is directed from the blower port 271 on to the front end of the paper to assist in the separation of the documents. The amount of adherence between the upper sheets is therefore reduced.

(9) With the document D1 remaining under suction, the clutch K is turned ON and the outer cylinder member 311 is rotated by the motor M1. At this time, the intermediate cylinder member 321 and the inner cylinder member 311 remain in a fixed position so that, when the feed of the document D1 commences, the suction ports 321A, 321D, 331A in the fully open state are completely sealed by the document D1 and the suction force required to feed the document is immediately restored in a stable manner and document feeding is carried out. The document D1 adhering to the outer peripheral surface of the outer cylinder member 311 is transferred while adhering to the outer cylinder member 311, and is therefore drawn out from the bottom of the document stack and conveyed.

Figure 8C:
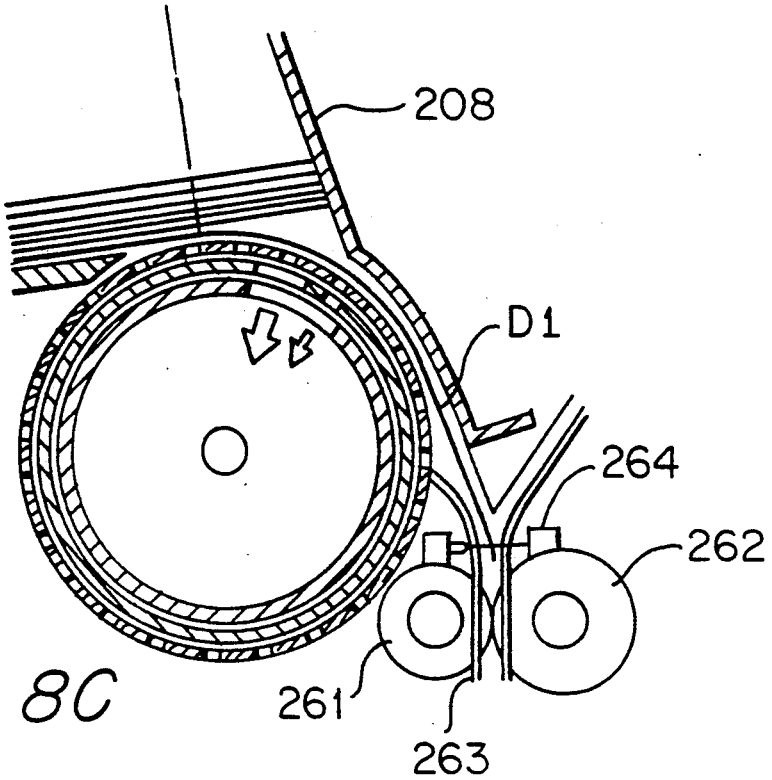
Figure 8D:
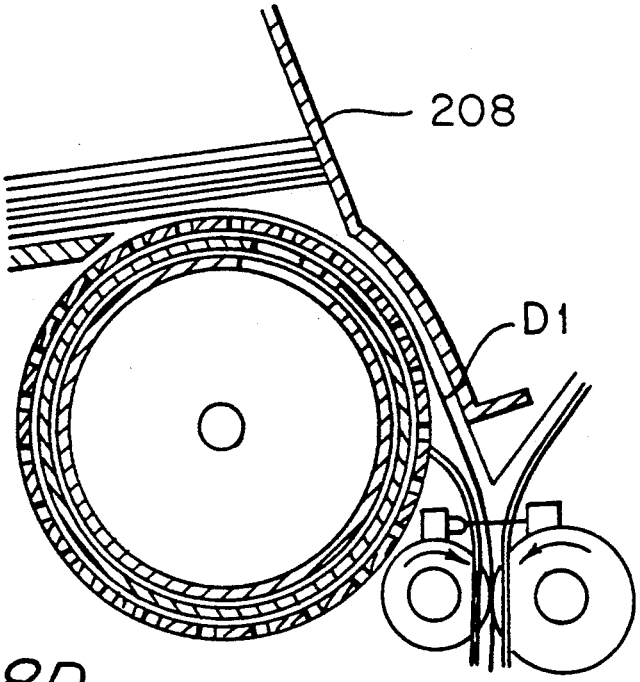

(10) The front end of the document D1 proceeds along the inner surface of the guide plate 263, and is detected by the document front end sensor 264. After the front end of the document is interposed in the nip position of the intermediate conveyor rollers 261, 262 the clutch K is turned OFF, the rotation of the intermediate conveyor rollers 261, 262 is temporarily halted, and the intermediate conveyor rollers 261, 262 enter the standby state to adjust to the timing of the copy paper from the resist roller of the paper feed device in the body of the copying machine. FIG. 8C is a sectional view of part of the paper feed device illustrating the standby state.

If the front end sensor 264 does not detect the arrival of the front end of a document after the outer cylinder member has been rotating for a fixed time this indicates that there is insufficient suction pressure (negative pressure) between the outer peripheral surface of the outer cylinder member 311 and the document D1, so that sliding is produced and unsatisfactory conveying results..

Countermeasures for the unsatisfactory conveying outlined above will now be described.

Figure 10:
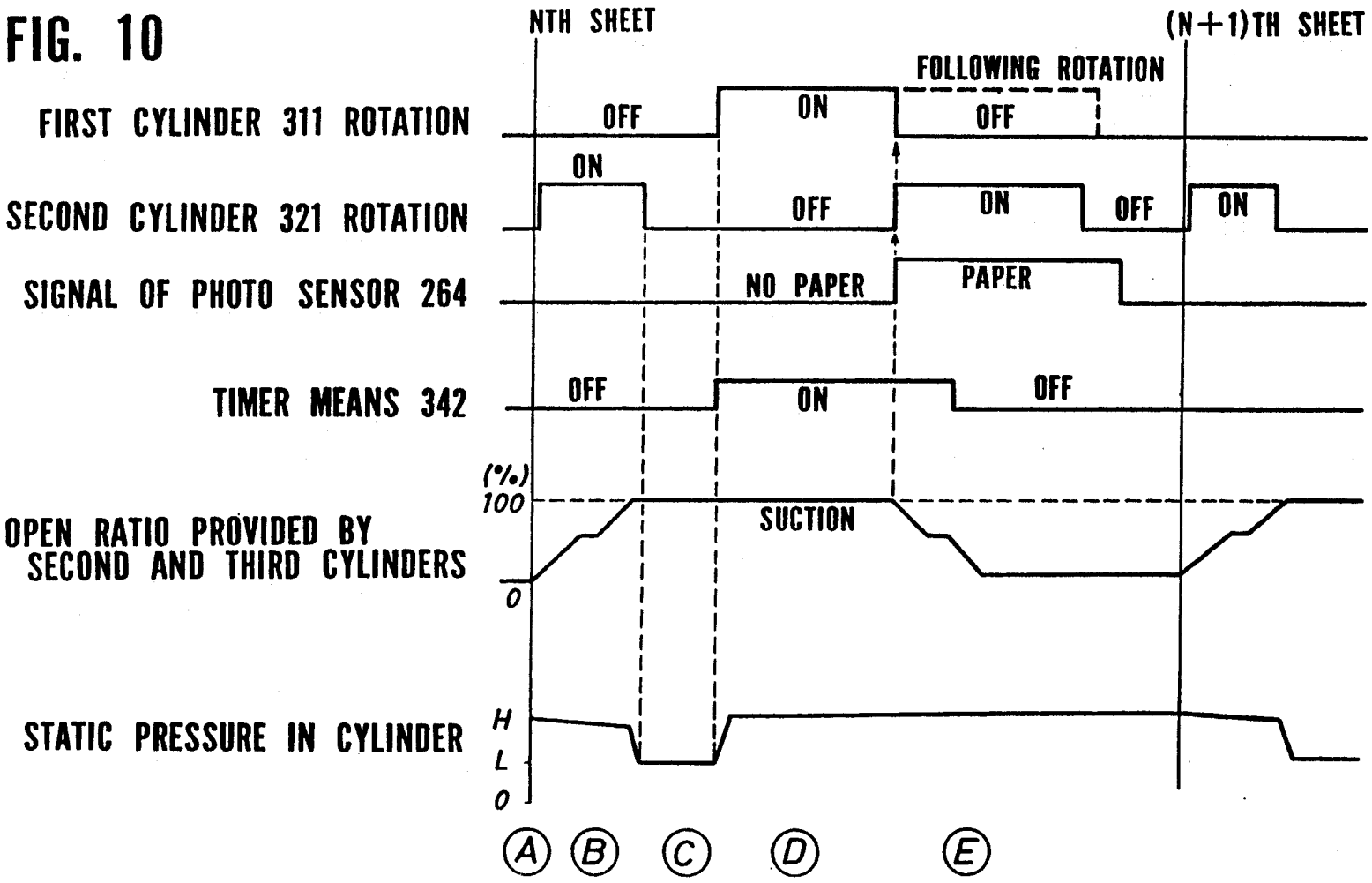
FIG. 10 is a timing chart for the paper feed process.
Figure 11:
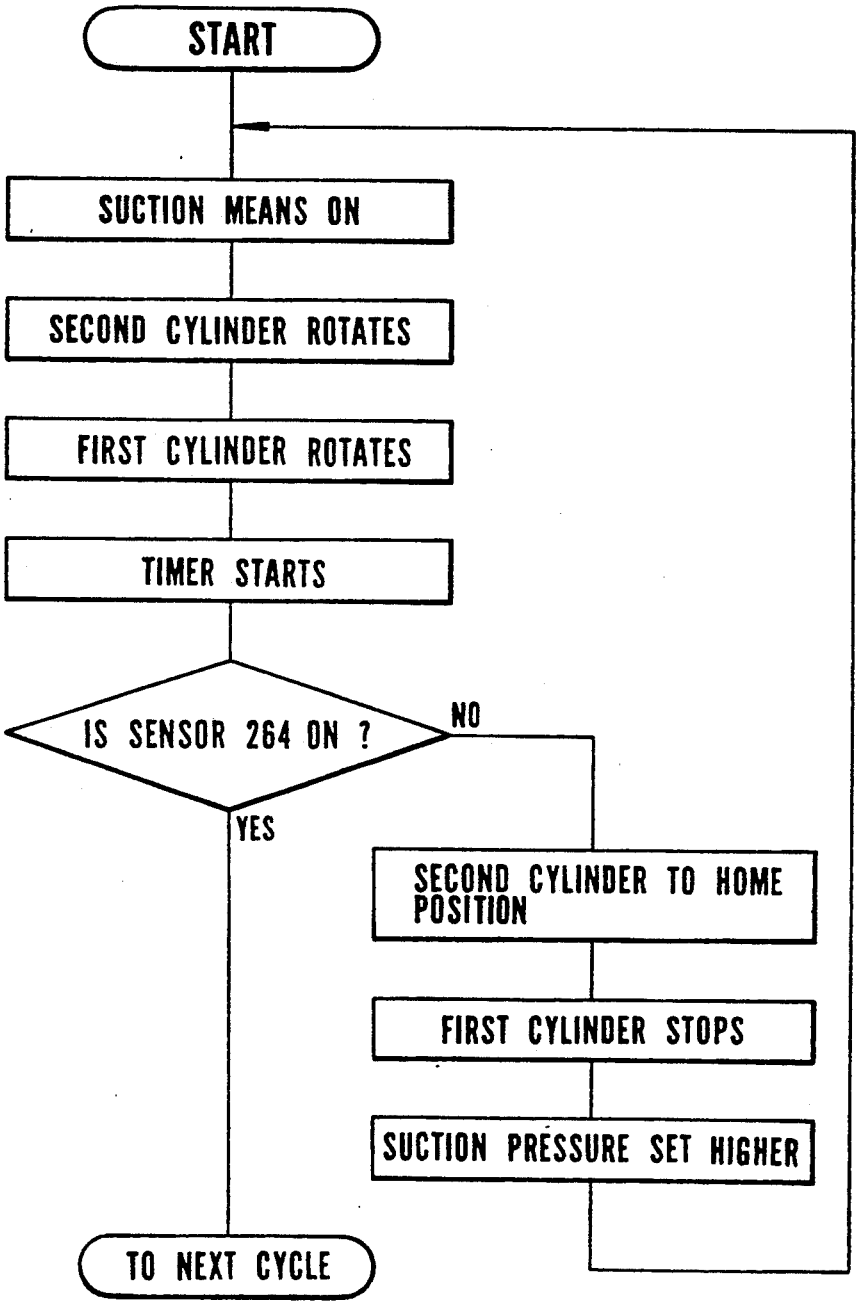
FIG. 11 is a flow chart for the paper feed process.

(11)-(a) As shown in the flowchart of FIG. 11 and the timing chart of FIG. 10, the process commences when the first cylinder 311 begins to rotate, and the timing commences when the timer means 342 is turned ON. If the sensor 264 has not detected the arrival of the front end of the paper after a predetermined time set on the timer has elapsed, the second cylinder 321 is rotatingly driven, and an opening relative to the third cylinder 331 is closed from the deviation of the ports 321A, 321B. The rotation of the first cylinder 311 is then halted.

(11)-(b) Next, the suction pressure of the suction means 340 is set to a value higher than the previous setting by the control means 341. For example, the number of RPM for driving the suction means 340 is increased and the suction pressure is increased from 200 mm Hg to 300 mm Hg.

(11)-(c) The second cylinder 321 is rotated with the suction set at a rather higher pressure, and the ports 321A, 321B, as previously described, are aligned with the port 331A of the third cylinder 331, and the paper feed operation once again commences.

(11)-(d) This cycle is repeated with the suction pressure maintained at the setting at which the paper reaches the sensor 264. The program then shifts to the next paper feed cycle, and the paper is conveyed to the handling section.

The suction pressure set as described above is suited for all the conditions of the paper in the stack at that time, so by setting the control to automatic, no matter what type of document is used, a stable conveying performance can always be obtained.

(12) The intermediate conveyor rollers 261, 262 once again begin to rotate following a timing paper feed start signal for the transfer paper, and the front end of the document 1 is conveyed to the pressure position of the conveyor belt 220 and the platen glass 102. (See FIG. 8D). During this time, the outer cylinder means 311 rotates followed by the document D. In addition, the intermediate cylinder member is rotatingly driven in the clockwise direction as indicated by the arrow, and halts on reaching the initial position (FIG. 8A).

(13) In this manner, one sheet of the document D1 sent out by the suction cylinder device 300 enters an advancing channel A and is nipped between the intermediate conveyor rollers 261, 262 provided partway along this channel. This sheet is conveyed at the exposure speed toward the platen glass 102 and the conveyor belt 220. When the document front end sensor 264 detects that the back end of the document D1 has passed a suction cylinder device 230, the next document is ready for feeding and receives a document feed signal from the main body.

(14) The document D1 which is conveyed by the intermediate conveyor rollers 261, 262, is exposed in the fixed optical system 110 while being conveyed at the exposure speed on the platen glass 102 by the conveyor belt 220, and forms an image on a photosensitive drum. Following exposure, the document D1 is moved along on the paper discharge guide plate 225, and is discharged to the document stacker 201 from the paper discharge belt 212.

The front and back ends of the document D1 which has been discharged onto the document stacker 201 are aligned by the document stopper 208 and the back end regulating plate 202. The document is once again stacked with the width aligned by the width regulating plates 203, 203. The documents D, which have been stacked previously, and the recycled documents D1 are classified by means of the document classifying device 210. This forwarding operation is repeated until there are no more documents D left on the document stacker 201. The fact that no more documents D remain is detected by the stack sensor 206, and when the forwarding of the last document D is detected by the paper discharge sensor, the abovementioned action is repeated until the set number of copies of the documents has been forwarded from the stacked documents at the back end regulating plate 202. Accordingly, when the completion of the set number of copies is detected by the paper discharge sensor, and when the removal of the stacked documents from the stack by the operator is detected by the document set detection sensor, the back end regulating plate 202 returns to the home position and is prepared for the next operation. The above operation has been described for the case where single-sided copies are made of a single-sided document in RDH mode. When single-sided copies are made of a double-sided document or when double-sided copies are made of a double-sided document, the documents are introduced into the channel E where they are reversed in somersault fashion.

With the embodiment described in the foregoing, the inner cylinder member 331 is fixed and the intermediate cylinder member 321 is drivenly rotated, but the present invention is not restricted to this embodiment. The intermediate cylinder member 321 may remain fixed and the inner cylinder member 331 may be drivenly rotated, or the bottom paper in the stack may be separated by suction while the relative openings formed by the slotted openings in both cylinder members are being switched from a closed state to a gradually opening state.

The paper feed device of the present invention effectively applies the document bottom feed method for the document conveying device, but in addition to this it is also possible to apply this to a paper feed device in which the paper is fed from the bottom of the stack.

As explained above, the paper feed device of the present invention forwards a stack of papers loaded on a document stacker in the feed direction, and separates the papers from the stack one at a time from the bottom using a separating means. Forwarding of the papers and separating and feeding is performed in a stable manner by means of a suction cylinder device comprising a triple-cylinder mechanism and a suction means, so that it is not necessary to apply pressure to the stacked papers. The production of spots or stains on the surface of the document and distortion of the image, or the like, caused by chafing of the top and bottom surfaces of the paper from the friction on each surface by the adjacent papers, are prevented.

The suction cylinder device with the triple-cylinder mechanism of the present invention can convey sheets of light paper (tracing paper or the equivalent of 40 to 45 kg paper) by suction at a negative pressure (about 200 mm Hg) and also convey relatively heavy paper (the equivalent of 70 to 110 kg paper) by automatic regulation of the suction pressure to provide the optimum suction pressure for the type of paper. For this reason the paper separating performance is improved and separating and conveying can be reliably carried out regardless of the paper size and weight. In addition, by providing holes in the outer cylinder, suction can be produced over the entire surface so that a uniform suction is applied to the surface of the paper for conveying. Therefore, double conveying, and the production of creases in the paper or bending of the corners can be eliminated, and a stable conveying operation can be provided.

What we claim is:

1. A paper feed device for separating sheets of paper one by one from the bottom of a stack of paper loaded on a paper loading tray and for feeding the separated paper sheets consecutively, comprising:

a rotatable hollow cylinder means for feeding the paper sheets, the cylinder means having an opening and being positioned below and close to the front end of the paper loading tray in the feed direction;

vacuum suction means for varying vacuum suction pressure in the cylinder means;

a paper front end sensor positioned downstream of the cylinder means;

conveyor means for interposedly supporting the paper sent forward from the cylinder means and for conveying the paper to a subsequent handling section;

timer means for setting a predetermined time in response to the start of paper feed operation of the cylinder means; and control means for controlling the paper conveying operation of the conveyor means in such a manner that said vacuum suction means is set at its lowest vacuum suction pressure at the time of starting the paper feed operation of the cylinder means, and after the predetermined time from the start of the paper feed operation set by the timer means has elapsed, if the paper front end detector has not detected the passage of the front end of the paper, the vacuum suction pressure from the vacuum suction means is successively increased to slightly higher pressures and the paper feed operation is repeated, and as long as the paper front end detector detects the passage of the front end of the paper, the vacuum suction pressure is maintained at the increased pressure.

2. A paper feed device for separating sheets of paper one by one from the bottom of a stack of paper loaded on a paper loading tray and for feeding the separated paper sheets consecutively, the feed device comprising:

a rotatable hollow cylinder means having a peripheral surface for feeding the paper sheets, the cylinder means being positioned below and close to the front end of the paper loading tray in the direction of paper sheet feed, and having an opening for drawing a paper sheet against the peripheral surface by vacuum suction;

vacuum suction means for varying vacuum suction pressure in the cylinder means between low and higher suction levels;

a paper sheet front end sensor positioned downstream of the cylinder means;

conveyor means for receiving a paper sheet fed by the cylinder means and for conveying the paper sheet from the cylinder means;

timer means for setting a predetermined time interval after the start of cylinder means operation to feed a paper sheet; and control means for controlling operation of the conveyor means and of said vacuum suction means to set the suction pressure at the low level at the start of a paper sheet feed operation by the cylinder means, and if, after the predetermined time interval, the passage of the paper sheet is not detected by the front end detector, the vacuum suction pressure in the cylinder means is increased to a higher level so that when the paper feed operation is repeated to feed successive paper sheets, the vacuum suction pressure is maintained at the higher level for so long as the front end detector detects the passage of the a paper sheet.

3. A paper feed device according to claim 2, wherein said cylindrical means comprises:

a rotatable pipe-shaped first cylinder to establish said peripheral surface and having a large number of small through-holes therein;

a pipe-shaped second cylinder, positioned inside the first cylinder and having a first slotted opening therein; and a pipe-shaped third cylinder, positioned inside the second cylinder and provided with a second slotted opening;

said vacuum suction means being combined with the third cylinder and one of the second and third cylinders being held stationary whereas the other is rotatable.

4. The paper feed device according to claim 3, wherein the slotted opening in the peripheral surface of the second cylinder comprises:

a plurality of main suction ports provided on at least one generatrix of the cylinder for feeding the paper by suction; and a plurality of auxiliary suction ports for applying suction close to the front end of the paper.

5. The paper feed device according to claim 4 wherein the auxiliary suction port is disposed in such a position as to be half-covered by the end of the paper which has been separated and held tightly against the first cylinder by the application of suction.

6. The paper feed device according to claim 4 wherein the open area of the main suction port of the second cylinder is greater than the open area of the auxiliary suction ports.

7. The paper feed device according to claim 3 wherein:

the first cylinder is fabricated from a flexible material with a thickness of one millimeter or less;

the second cylinder is rigid; and the spacing between the inner wall surface of the first cylinder and the outer wall surface of the second cylinder is maintained at one millimeter or less.

8. The method of feeding individual sheets by drawing consecutive bottom sheets of a stack against the periphery of a rotatable cylinder using vacuum suction applied to the cylinder interior, said method comprising the steps of:

setting the vacuum suction to a first level lower than a level that may be required to draw the first bottom sheet against the cylinder periphery;

increasing the vacuum suction as necessary to draw the first bottom sheet against the cylinder periphery if the first level is inadequate; and maintaining the vacuum suction at the level required to draw the first bottom sheet into feeding engagement with the cylinder for successive feeding of other sheets at the bottom of the stack.

* * * * *